United States Patent [19]

Morita et al.

[11] Patent Number: 4,485,616

[45] Date of Patent: Dec. 4, 1984

[54] METHOD AND APPARATUS FOR SUPPLYING VACUUM TO A TRAVELING-TYPE SERVICING DEVICE SERVING A PARENT MULTI-STATION TEXTILE MACHINE SUCH AS A SPINNING FRAME

[75] Inventors: Takayuki Morita, Kariya; Shigeru Muramatsu, Okazaki; Tatemi Fukuda, Aichi, all of Japan

[73] Assignee: Kabushiki Kaisha Toyoda Jidoshokki Seisakusho, Kariya, Japan

[21] Appl. No.: 464,915

[22] Filed: Feb. 8, 1983

[30] Foreign Application Priority Data

Feb. 10, 1982 [JP] Japan ..... 57-018898

[51] Int. Cl.[3] ..... D01H 11/00; D01H 15/00; D01H 9/02

[52] U.S. Cl. ..... 57/261; 57/263; 57/304; 242/35.5 R

[58] Field of Search ..... 57/301–305, 57/261–263, 411, 415; 242/35.5 R, 35.5 A

[56] References Cited

U.S. PATENT DOCUMENTS

| | | | |
|---|---|---|---|
| 3,077,311 | 2/1963 | Furst | 242/35.5 R |
| 3,839,764 | 10/1974 | Clayton | 57/301 X |
| 3,952,492 | 4/1976 | Miyazaki et al. | 57/301 |
| 4,038,812 | 8/1977 | Stahlecker | 57/301 |

FOREIGN PATENT DOCUMENTS

| | | | |
|---|---|---|---|
| 49-1668 | 1/1974 | Japan | 57/304 |

*Primary Examiner*—John Petrakes

*Attorney, Agent, or Firm*—Brooks Haidt Haffner & Delahunty

[57] ABSTRACT

Method and apparatus for supplying vacuum to a serving device which travels along a multi-station parent textile machine such as a spinning frame and providing a servicing operation such as yarn piecing or package doffing to the stations of the parent machine are disclosed, wherein a vacuum duct, which has vacuum outlet openings corresponding to the individual stations of the machine and lids rotatably supported for closing the vacuum outlet openings, is arranged along the parent machine and the servicing device includes a nozzle which takes in vacuum from the duct. The nozzle is advanced toward the vacuum duct just before the servicing device reaches a station which calls for the servicing, and the end of the nozzle rotates the lid to uncover its vacuum outlet opening and then is stopped in alignment with the opening. Then, the nozzle is moved with the servicing device to rotate the lid thereby closing the outlet opening, whereafter it is retracted to its original position. Thus, the vacuum outlet opening is uncovered by the lid only when necessary vacuum is being supplied, with the result that good airtightness may be maintained and loss of vacuum reduced to a minimum.

8 Claims, 4 Drawing Figures

METHOD AND APPARATUS FOR SUPPLYING VACUUM TO A TRAVELING-TYPE SERVICING DEVICE SERVING A PARENT MULTI-STATION TEXTILE MACHINE SUCH AS A SPINNING FRAME

BACKGROUND OF THE INVENTION

The present invention relates to a method and an apparatus for supplying vacuum to a traveling-type servicing device which is designed to perform a servicing operation such as yarn piecing or automatic package doffing at the individual stations of a parent multi-station textile machine such as a spinning frame, winder or fly frame.

In a servicing device, such as a yarn piecing or package doffing device, which serves the parent textile machine having an array of stations while traveling therealong, it is commonly known that vacuum has been extensively utilized by such a servicing device for the purpose of grasping a free end of a broken yarn or drawing in residual pieces of yarn for removal thereof. Though the servicing device is equipped with a tube or a nozzle for taking in vacuum, no vacuum source such as a blower is usually provided in the servicing device for the sake of reduction of weight and size thereof. Instead, a duct connected to any suitable source of vacuum and having vacuum outlet openings which may be covered by lids is arranged extending along the machine, and the servicing device positioned at any of the stations to be served thereby receives necessary vacuum from such a duct.

As a known method, e.g. U.S. Pat. No. 3,077,311, in which the servicing device takes vacuum from a duct, the duct has vacuum outlet openings formed on its face so as to correspond to the individual stations of the parent machine, and a cover plate or a lid is swingably supported on the duct for each of the vacuum outlet openings in such a way that the swinging motion of the lid can open and close the outlet opening. On the other hand, the servicing device has a vacuum supply tube projecting therefrom toward the duct and having an end which is normally placed in a sliding contact with the duct while the servicing device is in motion and engageable with the lid so as to swing it and, thereby, to open the vacuum outlet openings. This method is disadvantageous, however, in that the end of the vacuum supply tube wears rapidly because it is subjected to constant friction due to sliding contact thereof with the duct while the servicing device is traveling along the parent machine. Furthermore, each time the servicing device moves past the stations, the lid is caused to swing thereby to open even the vacuum outlet openings for those stations which need no yarn piecing or package doffing service by the servicing device. Therefore, ambient air is allowed into the duct through the opened vacuum outlets, with the natural result that sufficient degree of airtightness between the lid and the vacuum outlet opening cannot be maintained. In addition, the lid returns by its own weight to its original position where the vacuum outlet opening is covered with the lid, there is a fear of further decrease of airtightness due to poor reliability in lid motion.

An attempt to improve the above-mentioned method was made by the Japanese Patent Publication 49-1668, according to which the vacuum supply tube is arranged so as to be movable toward and away from the vacuum duct, and the lid which is formed into a multiple-petal shape is rotated by a pin which is moved by and with the servicing device along the parent machine, whereby the vacuum supply tube is connected to the vacuum outlet opening by moving forward to the duct only when any station is to be served by the servicing device. In this method, however, the multiple-petal lid is rotated by the pin each time the pin moves therepast. As a result, poor airtightness remains unsolved and frequent rotating action of the lid promotes wear between the lid and the duct surface.

SUMMARY OF THE INVENTION

It is the object of the present invention, therefore, to provide a solution to the insufficiency in airtightness of the vacuum duct and to provide a method and an apparatus for supplying vacuum to the servicing device of a parent textile machine with a minimum loss of vacuum.

According to the preferred embodiments of the invention, these objects are accomplished by allowing the vacuum supply tube or a nozzle to be brought into sliding contact with the vacuum duct and by rotating the lid to open the vacuum outlet opening only when a servicing job is to be performed by the servicing device at a station of the parent textile machine. Namely, the method according to the invention for supplying vacuum to the traveling-type servicing device may be achieved by performing the following steps which include moving the nozzle of the servicing machine to the vacuum duct on the parent textile machine before the servicing device reaches a position which is determined by the position of the vacuum outlet opening on the duct at a station of the parent machine which is to be served by the servicing device, opening the vacuum outlet opening by rotating the lid by the end of the nozzle moving with the servicing device along the parent machine, stopping the movement of the servicing device where the nozzle is brought in alignment with the vacuum outlet opening thereby allowing vacuum in the duct to be supplied to the servicing machine via the nozzle, after the desired service of the station by the servicing device has been completed, closing the vacuum outlet opening with the lid by starting the servicing device the nozzle of which is engaged at the end thereof with the lid, and finally moving the nozzle back to its retracted position. The apparatus which embodies the invention, on the other hand, comprises a vacuum duct disposed along the parent machine and having vacuum outlet openings formed so as to correspond to the individual stations of the machine and multi-petal lids each of which is rotatably supported and arranged to normally close each of the vacuum outlet openings, a nozzle provided on the servicing device and engageable with the lid to rotate the same and also communicable with the vacuum outlet opening thereby feeding vacuum via the nozzle to the servicing device, an air cylinder for moving the nozzle toward and away from the vacuum duct, and actuators such as solenoid valves.

As a further embodiment of the invention, it may be contemplated to form a projection on each petal of the lid on the trailing side thereof with respect to the direction of rotation of the lid and another projection protruding from the nozzle in such a way that the first projection on the lid petal may engage with the second projection of the nozzle so that the lid is caused to rotate through engagement of these projections for opening and closing the vacuum outlet opening. Provision of such projections requires the lid to have only three petal portions in contrast with four petal portions of a lid required by the earlier-mentioned prior art disclosed by the Japanese Patent Publication 49-1668. Such reduction of the number of petals of a lid can make the distance between any two adjacent vacuum outlet openings smaller than heretofore. In other words, the station-to-station distance of a textile machine may be reduced, which can in turn increase the number of stations in a parent textile machine.

The above and other objects, features and advantages of the present invention will become apparent to whose skilled in the art from the following detailed description of preferred embodiments of the invention, taken in conjunction with the accompanying drawings, wherein:

DETAILED DESCRIPTION OF THE PREFERRED EMBODIMENTS

Figure 1:
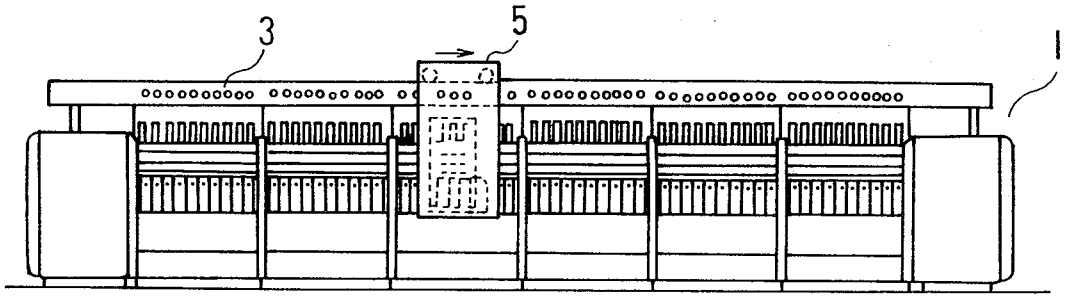
FIG. 1 is a front view showing a parent textile machine such as an open-end spinning frame and a servicing device which travels therealong.
Figure 2:
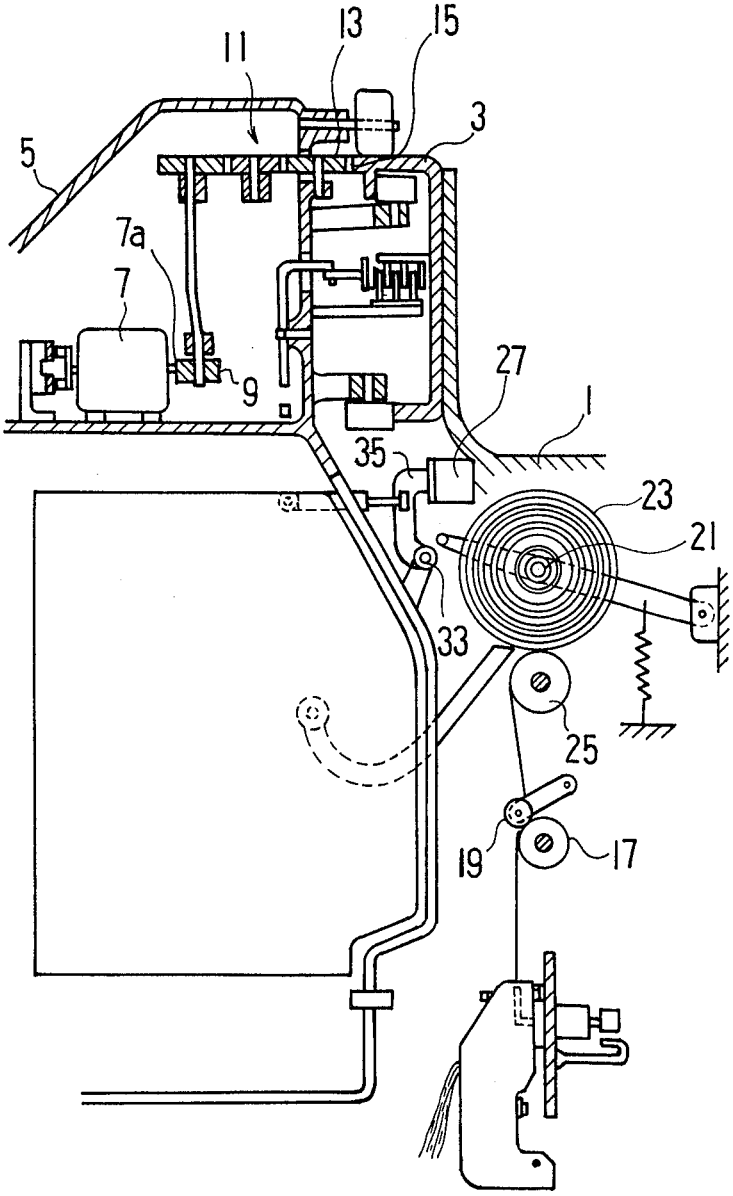
FIG. 2 is a partial cross section in an enlarged scale of the textile machine and the servicing device of FIG. 1, the latter being located at a spinning station of the former.

Referring to FIG. 1, a textile machine which in the illustrated embodiment is an open-end spinning frame having a plurality of spinning stations arranged therealong is generally shown by a reference numeral 1. A guide rail 3 is provided along the parent textile machine 1, and a servicing device 5 for performing a servicing job such as yarn piecing or package doffing at any required station is movably carried by the guide rail 3. The servicing device 5, whose enlarged view is shown in FIG. 2, includes a motor 7 having an output shaft 7*a* on which a worm (not shown) engaging with a worm wheel 9 is fixed. The power from the motor 7 is transmitted through the worm wheel 9 and a gear train 11 to a gear 13 which is engaged with a rack 15 provided on the parent machine 1, whereby the servicing device 5 is thus driven to travel along the guide rail 3, therefore along the parent textile machine 1 while moving past the individual spinning stations.

Each spinning station of the machine 1 includes a delivery roller 17, a top roller 19 pressed against the delivery roller 17, and a winding drum 25 for forming a yarn package 23 on a bobbin 21 while traversing the spun yarn. It is a usual practice for the servicing device 5 to utilize vacuum for grasping an end of a broken or cut yarn or removing residual pieces of yarn from any of the above-mentioned parts in such a spinning station. The servicing device 5 includes no vacuum source such as a blower for reduction of weight and size and simplicity in structure of the device itself, but a vacuum duct 27 is arranged to extend along the parent machine 1 and the servicing device 5 includes a nozzle 35 which is adapted to receive vacuum from the duct 27.

The vacuum duct 27 is connected to any suitable source of vacuum (not shown) and has vacuum outlet openings 27*a* formed on the front face thereof and positioned so as to correspond to the individual spinning stations of the machine 1. To cover and close the vacuum outlet openings 27*a*, cover plates or lids 29 are supported by pins 31 on the front face of the vacuum duct 27 for the individual outlet openings 27*a*. As shown clearly in FIG. 4, each lid 29 includes three petal-shaped portions 29*a* each having a projection 29*b* of any desired length on the trailing side thereof with respect to the direction of rotation thereof. The back side of the petals 29*a* of the lid 29 are airtightly contactable with the front face of the vacuum duct 27 so that the vacuum outlet openings 27*a* can be sealed successfully when closed. In this way, rotation of the lid 29 about the pin 31 will cause the outlet opening 27*a* to be opened and closed alternately.

Figure 3:
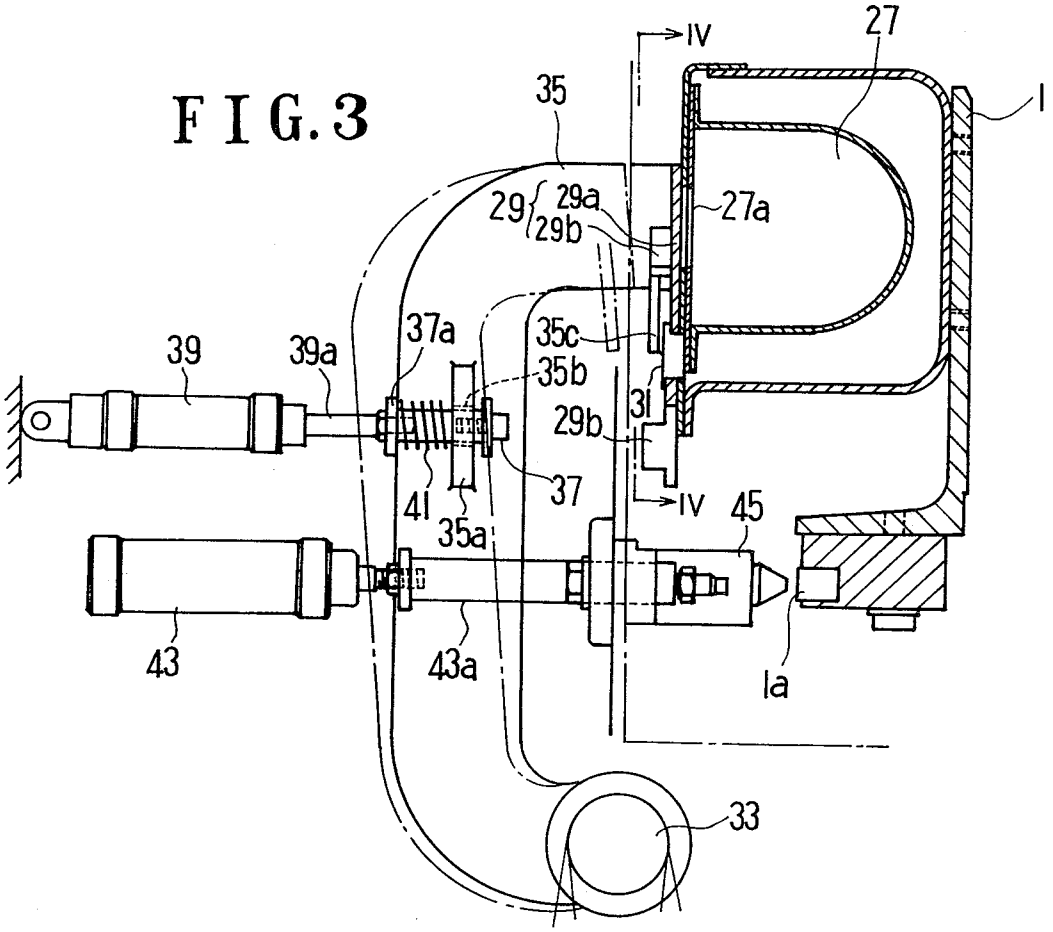
FIG. 3 is a further enlarged cross section of FIG. 2, showing the details thereof.

The nozzle 35 for receiving vacuum from the duct 27 is swingably supported on a shaft 33 which is mounted to the servicing device 5. As shown in FIG. 3, the nozzle 35 has a bracket 35*a* projecting from a lateral side thereof and having a hole 35*b* formed therethrough through which a rod member 37 is installed in a free state. The rod member 37 is fixedly connected to the end of a piston rod 39*a* of an air cylinder 39 which is mounted pivotally to the servicing device 5, and a shock-absorbing compression spring 41 is installed over the rod member 37 between a flanged portion 37*a* of the rod member 37 and the bracket 35*a*. Thus, when the air cylinder 39 is operated to move the piston rod 39*a* toward the machine 1, the nozzle 35 pivots on the supporting shaft 33 in a direction to move the free end thereof toward the machine 1 until engagement with the vacuum duct 27 (as shown by full line in FIG. 3); while, when the air cylinder 39 is operated so as to cause the piston rod 39*a* to move away from the machine 1, the end of the nozzle 35 is released from engagement with the vacuum duct 27 (as shown by dash-and-dot line in FIG. 3). The nozzle is provided with a projection 35*c* which is adapted to engage with the projection 29*b* on any of the petals 29*a* of the lid 29 when the nozzle 35 in its advanced position is moved in a sliding contact with the vacuum duct 27. Below the air cylinder 39 is disposed another cylinder 43 having a locating pin 45 at the end of a piston rod 43*a* thereof moveable toward and away from the machine and engageable with a recessed hole 1*a* formed on the machine 1. The recessed hole 1*a* is so positioned in the machine 1 that engagement of the locating pin 45 with the hole 1*a* can locate the servicing device 5 properly in relation to the individual spinning stations.

Figure 4:
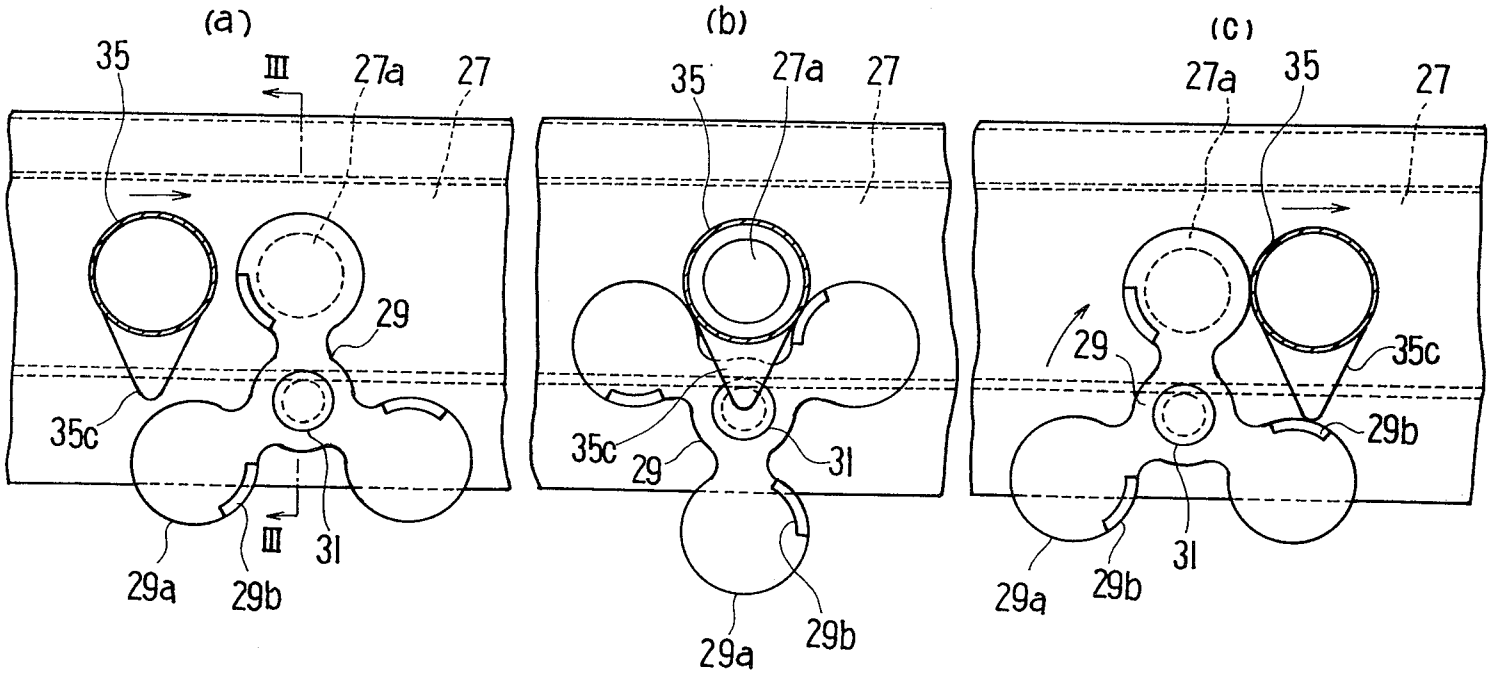
FIG. 4 comprises a series of schematic sectional views (*a*), (*b*) and (*c*) taken along and as seen from the line IV—IV of FIG. 3, illustrating three different phases in the mode of operation according to a preferred embodiment of the invention, the line III—III denoting the line along which the cross section of FIG. 3 is taken.

The operation of the apparatus according to the preferred embodiment of the invention will now be explained with reference to FIGS. 3 and 4. In FIG. 4 which illustrates three different phases in the operation of the apparatus, the servicing device 5 is traveling from left to right as indicated by an arrow marking. When the servicing device 5 is traveling along those spinning stations which call for no servicing such as yarn piecing or package doffing, the piston rod 39*a* of the cylinder 39 is placed in its retracted position away from the machine 1 as shown by dash-and-dot line in FIG. 3 and, therefore, the end of the nozzle 35 is clear of the front face of the vacuum duct 27 without making contact engagement with the lids 29. Accordingly, the vacuum outlet openings 27*a* on the vacuum duct 27 for the stations not calling for servicing can be kept closed even while the servicing device 5 moves past such stations.

When the servicing device 5 is called upon to perform a servicing operation at any specific spinning station of the machine 1, it is moved toward that station and the cylinder 39 is operated to advance the piston rod 39*a* toward the machine 1 before the servicing device 5 reaches a predetermined position in advance of the station in question. This motion of the piston rod 39*a* compresses the spring 41 and the nozzle 35 pivots about the shaft 33 by the action of the spring 41 in a direction which will cause the free end of the nozzle 35 to be pressed against the front face of the vacuum duct 27. Provision of the compression spring 41 serves to prevent the nozzle end from contacting the vacuum duct 27 with a damaging shock. As the nozzle 35 is moved further rightwardly as indicated by an arrow from the position shown in FIG. 4(*a*) with its end thus pressed against the front face of the vacuum duct 27, the end is brought into engagement with one of the petals 29*a* of the lid 29 and then rotates the lid 29 about the pin 31. At any appropriate time before or after such engagement of the nozzle end with any one of the petals 29*a* of the lid 29, the motor 7 is turned off to cut off the driving power to the servicing device 5, thus allowing it to run by inertia. During this movement by inertia, the locating cylinder 43 is operated to move its piston rod 43*a* forward for engaging the locating pin 45 with the recessed hole 1*a* on the machine 1. When such engagement occurs, the servicing device 5 is stopped and positioned with the nozzle 35 placed in alignment with the vacuum outlet opening 27*a* for the spinning station to be served by the servicing device 5. In this position shown in FIG. 4(*b*), the nozzle 35 communicates with the duct interior filled with vacuum and, therefore, simultaneously vacuum is fed from the duct 27 via the nozzle 35 to the servicing device 5 to be utilized for servicing by the servicing device 5, such as grasping of an end of a broken yarn or removing yarn residues, at the station.

After the required servicing of the station has been completed, the locating cylinder 43 is operated so as to retract its piston rod 43*a* for disengaging the locating pin 45 from the recessed hole 1*a*, as shown in FIG. 3. The motor 7 is then turned on for initiating the servicing device 5 to move rightwardly as viewed in FIG. 4. With the movement of the nozzle 35 along with the servicing device 5, the lid 29 which is still in engagement with the nozzle end is rotated on the pin 31 to close the vacuum outlet opening 27*a* by the succeeding petal 29*a* of the lid 29.

Though the previously-mentioned prior art requires the lid to have at least four petal portions in order to close the vacuum outlet opening by rotating the lid through engagement between the nozzle end and the lid petal, the above-illustrated embodiment of the invention wherein the nozzle 35 and the petals 29*a* of the lid 29 are formed with projections 35*c* and 29*b*, respectively, which are engageable with each other while the former is rotating the latter, requires the lid 29 to have only three petal portions 29*a* for closing the vacuum outlet opening 27*a* by rotating the lid 29 by the nozzle end.

After the servicing device 5 has started to move from the position of FIG. 4(*c*) and the vacuum outlet opening 27*a* has been closed, the cylinder 39 is operated so as to retract the piston rod 39*a* to its original position shown by dash-and-dot line in FIG. 3, in which position the end of the nozzle 35 can clear the petals 29*a* of the lid 29 for other spinning stations unless the servicing device 5 is called upon to provide servicing to any of such stations. In this way, while the servicing device 5 is traveling along and past these stations which need no servicing operation, the vacuum outlet openings of such stations can be kept closed, thus allowing no vacuum leakage due to unnecessary opening of the lids 29.

According to the embodiments of the present invention, as it is now apparent to those skilled in the art, the vacuum outlet opening for the station is opened only when it is served by the servicing device and otherwise kept closed, so that airtightness of the vacuum duct can be maintained successfully and vacuum loss reduced to a minimum. Furthermore, since the nozzle is brought into a sliding contact with the vacuum duct only when it is required to do so, rapid wear on the nozzle end may be prevented.

While the invention has been illustrated and described with reference to specific embodiments thereof, it is to be understood by those skilled in the art that various changes in the details of construction and arrangement may be made without departing from the spirit and scope of the invention.

What is claimed is:

1. A method for supplying vacuum to a servicing device which travels along a parent textile machine such as a spinning frame and provides a servicing operation to the respective stations of said parent machine, wherein vacuum is created in a duct means arranged along said stations, said duct means is provided with vacuum outlet openings corresponding to the individual stations of said parent machine and lid means rotatably supported for closing said vacuum outlet openings, and said servicing device includes a nozzle means communicable with said vacuum outlet openings, said method comprising the steps of:

moving said nozzle means to said vacuum duct means before said servicing device reaches a predetermined position at any one of said stations which is to be provided with a servicing operation by said servicing device;

rotating said lid means using the free end of said nozzle means traveling along with said servicing device so as to uncover the vacuum outlet opening for said one station;

stopping said servicing device at said predetermined position where said nozzle means on said servicing device is substantially aligned with said vacuum outlet opening for communicating said nozzle with vacuum in said duct means;

after the required servicing job by said servicing device is over, initiating said servicing device to travel, thereby covering said vacuum outlet opening with said lid means by rotating the same using the free end of said nozzle means; and moving said nozzle means away from said duct means back to the retracted position thereof.

2. A method as set forth in claim 1, wherein the first and last steps of said moving the nozzle means are effected by operation of a cylinder having a piston rod which is connected in any way with said nozzle means.

3. An apparatus for supplying vacuum to a servicing device which travels along a parent multi-station textile machine such as a spinning frame and provides a servicing operation to the stations of said parent machine, comprising:

a duct means arranged along said multiple stations of said parent machine, connected to any source of vacuum to create vacuum therein, and having respective vacuum outlet openings formed correspondingly to the individual stations and respective lid means for said vacuum outlet openings, each of said lid means being rotatably supported in such a way as to cover and uncover its associated vacuum outlet opening;

a nozzle means provided on said servicing device, movable to and away from said duct means, engageable with each said lid means and also communicable with vacuum in said duct means via said vacuum outlet openings, said nozzle means having lid-engagement means thereon and each said lid means having nozzle-engagement means thereon for engagement with each other to positively urge each of said lid means during its said movement to cover and uncover its said associated vacuum outlet opening; and means for actuating said nozzle means toward said duct means to align its said lid-engagement means for engagement with said nozzle-engagement means on said lid means as said servicing device travels and approaches any selected one of said stations and away from said duct means as said servicing device travels and moves away from said selected one of said stations.

4. An apparatus as set forth in claim 3, wherein each said lid means comprises multiple, radially projecting petal-shaped portions each of which is adapted to cover said vacuum outlet opening successively during rotation of the lid means.

5. An apparatus as set forth in claim 4, wherein each of said petal-shaped portions has a projection formed at the trailing side thereof with respect to the direction of rotation of said lid means and said nozzle means has a projection formed on an end thereof facing said duct means, said projections being engageable with each other.

6. An apparatus as set forth in claim 5, wherein said lid means has three petal-shaped portions.

7. An apparatus as set forth in claim 5, wherein each said lid means is pivotably mounted on said duct means at a location below its associated vacuum outlet opening, and said projection on said nozzle means projects below said nozzle means end a distance whereby it retains its said engagement with said projection on each said petal portion until the next succeeding petal portion covers said associated vacuum outlet opening during movement of said servicing device away from the latter.

8. An apparatus as set forth in claim 3, wherein said actuating means includes a cylinder-and-piston assembly.

* * * * *